US005670022A

United States Patent [19]

Bengtsson

[11] Patent Number: 5,670,022

[45] Date of Patent: Sep. 23, 1997

[54] TOP ROLL LIFTING ARRANGEMENT FOR A PRESS IN A PAPERMAKING OR BOARDMAKING MACHINE

[75] Inventor: Roland Bengtsson, Karlstad, Sweden

[73] Assignee: Valmet-Karlstad AB, Sweden

[21] Appl. No.: 719,474

[22] Filed: Sep. 25, 1996

[30] Foreign Application Priority Data

Sep. 27, 1995 [SE] Sweden ..... 9503358

[51] Int. Cl.[6] ..... D21F 3/00

[52] U.S. Cl. ..... 162/272; 100/153; 100/168; 162/274; 162/358.1

[58] Field of Search ..... 162/272, 273, 162/274, 358.1; 100/153, 168; 72/238

[56] References Cited

U.S. PATENT DOCUMENTS

| | | | |
|---|---|---|---|
| 3,352,747 | 11/1967 | Lithgo et al. | 162/274 |
| 4,560,441 | 12/1985 | Kraft et al. | 162/273 |
| 5,091,056 | 2/1992 | Autio | 162/360.1 |
| 5,207,872 | 5/1993 | Vallius | 162/272 |
| 5,399,242 | 3/1995 | Schiel | 162/272 |
| 5,507,223 | 4/1996 | Jansson | 162/388.1 |

FOREIGN PATENT DOCUMENTS

WO95/15413 6/1995 WIPO .

*Primary Examiner*—Karen M. Hastings
*Attorney, Agent, or Firm*—Bell, Seltzer, Park & Gibson

[57] ABSTRACT

A top roll lifting arrangement for a roll press in a press section of a papermaking or boardmaking machine where the roll press includes a top roll and a bottom roll, the rolls being opposed and parallel and having main axes defining a press plane and forming between them a press nip. The press has a framework including two side frames in parallel relationship to each other, one located on the drive side of the machine and the other one on the tender side of the machine. Each side frame has a first vertical column upstream of the press nip and a second vertical column downstream of the press nip. The upper roll is carried by a brackets extending between the upstream and downstream vertical columns. The brackets have bevelled ends that co-operate with inclined surfaces of plate members on the vertical columns.

6 Claims, 5 Drawing Sheets

TOP ROLL LIFTING ARRANGEMENT FOR A PRESS IN A PAPERMAKING OR BOARDMAKING MACHINE

FIELD AND BACKGROUND OF THE INVENTION

The present invention relates to a top roll lifting arrangement for a roll press in a press section of a papermaking or boardmaking machine having a drive side and a tender side, the roll press including a top roll and a bottom roll and the rolls being opposed and parallel and having main axes which define a generally vertical press plane and which together form a press nip, and where the press has a framework for the rolls, the framework including two side frames in a parallel relationship to each other, one located on the drive side and the other one on the tender side of the machine, each of the side frames having a first and a second vertical column, the first column being located upstream of the press nip and the second one being located downstream of the press nip, the first and the second vertical column in each side frame being interconnected by a horizontally extending top beam.

When a fibrous web passes through a press in the press section of a papermaking or boardmaking machine, it usually runs on one or more endless fabrics, such as press felts, forming a loop around the top and/or the bottom roll of the press and defining a single-felted or a double-felted press nip. When a new felt, or a pair of new felts, is to be substituted for a worn felt, or a pair of worn felts, respectively, the rolls of the press must be spaced apart. The spacing apart of the rolls is usually achieved by lifting the upper or top roll from the lower or bottom roll. In U.S. Pat. No. 5,091,056 (Autio) a press section is disclosed, in which an upper press roll is attached to an articulated part which can be pivoted by means of a power unit. When the power unit is activated, the upper roll is pivoted upwards, away from the lower roll. Other examples of spacing apart rolls in a press are disclosed in U.S. Pat. No. 3,352,747 (Lithgo et al.) and U.S. Pat. No. 4,560,441 (Kraft et al.).

In some presses having a compact frame design, it is desirable that the upper roll will not be displaced in a horizontal direction, i.e. in a direction parallel with the machine direction, when the upper roll is lifted, since the geometry of the frame might not permit horizontal displacement of the upper roll. Unless the necessary spacing of the upper from the lower roll is very small, a pivoting of the upper roll will result in a considerable displacement of the upper roll in a direction parallel to the machine direction. When the rolls are mounted in bearing housings resting on each other as disclosed in International Patent publication No. WO 95/15413 (Valmet-Karlstad AB), for example, the two rolls have to be spaced apart a considerable distance. In such a design, the spacing apart must be large enough to permit a new felt to be introduced without being obstructed by either the rolls or the bearing housings of the rolls, and the necessary spacing might be on the order of 0.2 to 0.25 meters.

The press section disclosed in the above-mentioned WO 95/15413 has a lifting arrangement in which the upper roll is pivoted to its raised position. This is possible since this press section does not employ an upper felt and therefore has no need for an upper framework. However, if a press section of a design otherwise similar to the one disclosed in the discussed document is to have an upper felt, an upper framework supporting the upper felt will be necessary.

Therefore, there is a need for a top roll lifting arrangement which permits the top roll to be lifted and lowered vertically instead of being pivoted.

Furthermore, during operation of the press, it is necessary that the position of the upper press roll is stabilized in the machine direction.

SUMMARY OF THE INVENTION

It is an object of the invention to accomplish a top roll lifting arrangement which permits quick and easy replacement of worn felts.

It is also an object of the invention to provide vertical lifting and lowering of the top roll.

An additional object of the invention is to stabilize the position of the top roll in the machine direction during operation of the press.

These objects are attained by the present invention which is directed to a top roll lifting arrangement for a roll press with two opposed and parallel rolls, one upper or top roll and one lower or bottom roll, for imparting pressure to a fibrous web, such as a paper web, in a nip between the press members. A press plane is defined by the main axes of the rolls. The press has a framework for the rolls. The framework includes two side frames in parallel relationship to each other, one adapted to be located on the drive side of the machine and the other one on the tender side of the machine. Each of the side frames has a first and a second vertical column, one located upstream of the press nip and one located downstream of the press nip. The vertical columns are interconnected by a horizontally extending top beam.

The arrangement includes a bracket mounted between the vertical columns of each side frame, the brackets carrying the upper roll and each bracket having one end upstream of the press nip and one end downstream of the press nip. For lifting a bracket with its upper roll, a lifting unit such as a pair of hydraulic cylinders might be employed.

According to the invention, the vertical columns of the side frames are provided with plate members, each plate member having a guide and support surface, the guide and support surface facing in the machine direction and being inclined in a downwards direction towards the press plane. The guide and support surface of the first vertical column is placed facing that of the second vertical column so as to define between the guide and support surfaces a gap converging in a downward direction. The ends of the brackets carrying the upper roll are bevelled so as to form inclined portions converging in a downward direction towards the press plane and adapted to co-operate with the plate members on the vertical columns in such a way that when the bracket with its roll is lowered, the plate members on the vertical columns will, together with the inclined portions of the bracket, guide the bracket during lifting and lowering of the bracket and, during operation of the press, serve to stabilize the upper roll in the machine direction.

DETAILED DESCRIPTION OF THE ILLUSTRATED EMBODIMENTS

Figure 1:
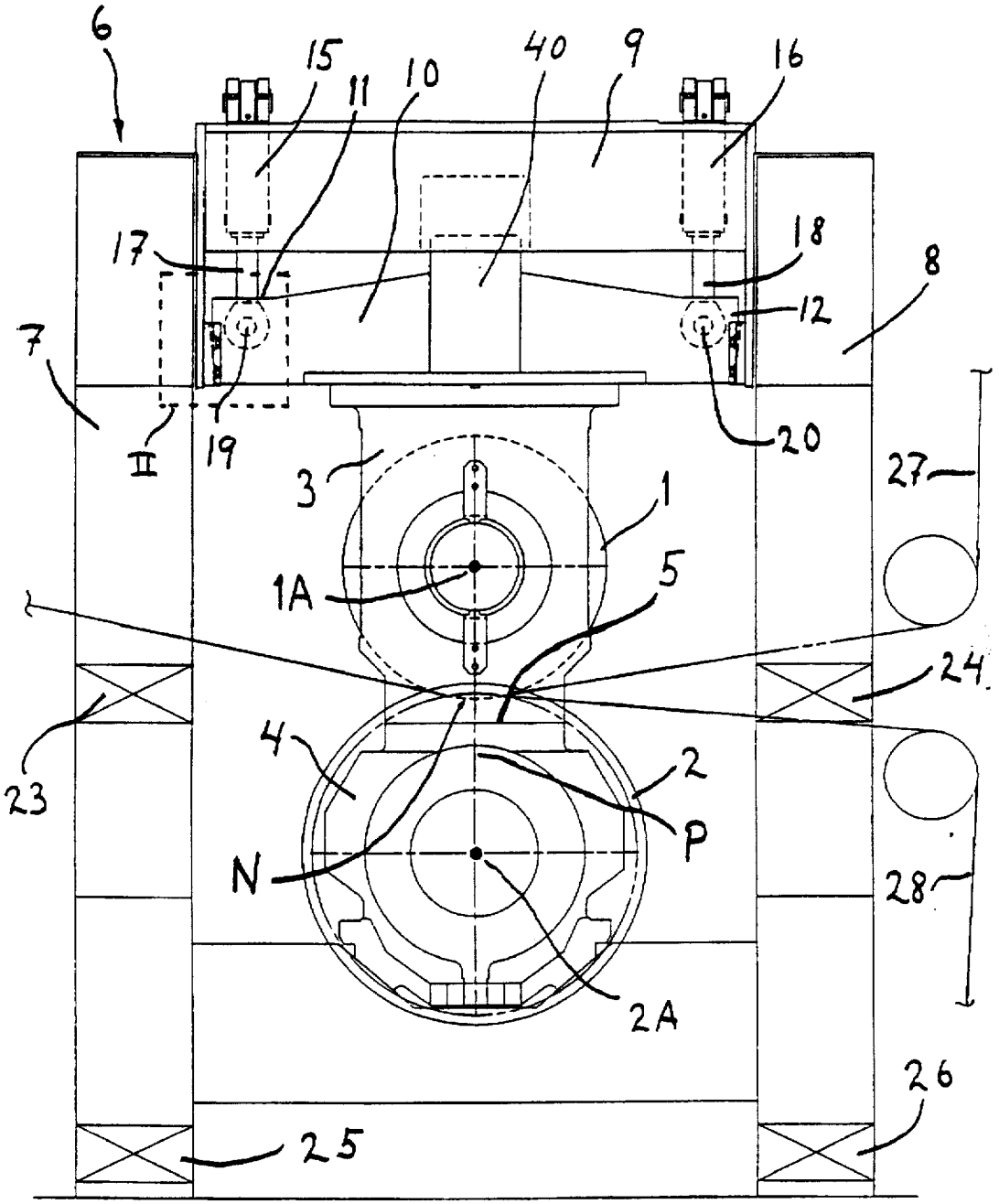
FIG. 1 is a schematic side view of the press section of a paper making machine.

With reference to FIG. 1, a roll press in a paper making machine having a drive side and a tender side is shown where a fibrous web passes between a pair of opposed and parallel press members such as an upper or top roll 1 and a lower or bottom roll 2 having main axes 1A and 2A which define a generally vertical press plane P and which form together a press nip N for the web. On the drive side and the tender side, the rolls are mounted in respective upper and lower bearing housings 3 and 4, the bearing housings being held together during operation of the press by a connecting element, symbolically indicated by reference numeral 5.

The press has a framework for the rolls which includes two side frames in parallel relationship to each other, one located on the drive side of the machine and one on the tender side of the machine. In FIG. 1, the side frame on the tender side is shown. Each side frame, generally designated 6, comprises a first vertical column 7 upstream of the press nip formed between the rolls 1 and 2 and a second vertical column 8 downstream of the press nip. To enable installation of new felts, the columns of the side frame on the tender side have removable intermediate pieces 23, 24, 25 and 26.

On each side of the press, the upper bearing housing 3 is mounted on a bracket 10 which extends between the first and the second column of each side frame and which has a first end 11 upstream of the press nip and a second end 12 downstream of the press nip. The upper roll 1 is thus carried by or hanging from the brackets 10 through the upper bearing housings 3. The brackets 10 on the drive side and the tender side are connected to each other by a cross beam 40.

At their upper end, the vertical columns of each side frame are interconnected by a horizontally extending top beam 9 which carries a lifting device formed by a pair of actuators, such as hydraulic cylinders 15 and 16, one connected to the upstream end of the bracket 10 and the other connected to the downstream end of the bracket 10. The hydraulic cylinders have piston parts 17 and 18 connected to the bracket 10 by pins 19 and 20 fitting into holes or apertures 21 in the bracket 10. By activating the hydraulic cylinders 15 and 16, the bracket 10 together with upper bearing housing 3 and upper roll 1 can be lifted from a lower, operational position to an elevated, non-operational position.

In FIGS. 2 to 5, the upper part of the side frame upstream of the press nip is shown together with the upstream end of bracket 10. The downstream part of the frame and the downstream end of the bracket (to the right in FIG. 1) is not shown in detail, but it should be understood that the downstream part of the frame and the downstream end of the bracket are similar to what is shown in FIGS. 2 to 5 and that what is described applies to both side frames in the framework.

Figure 2:
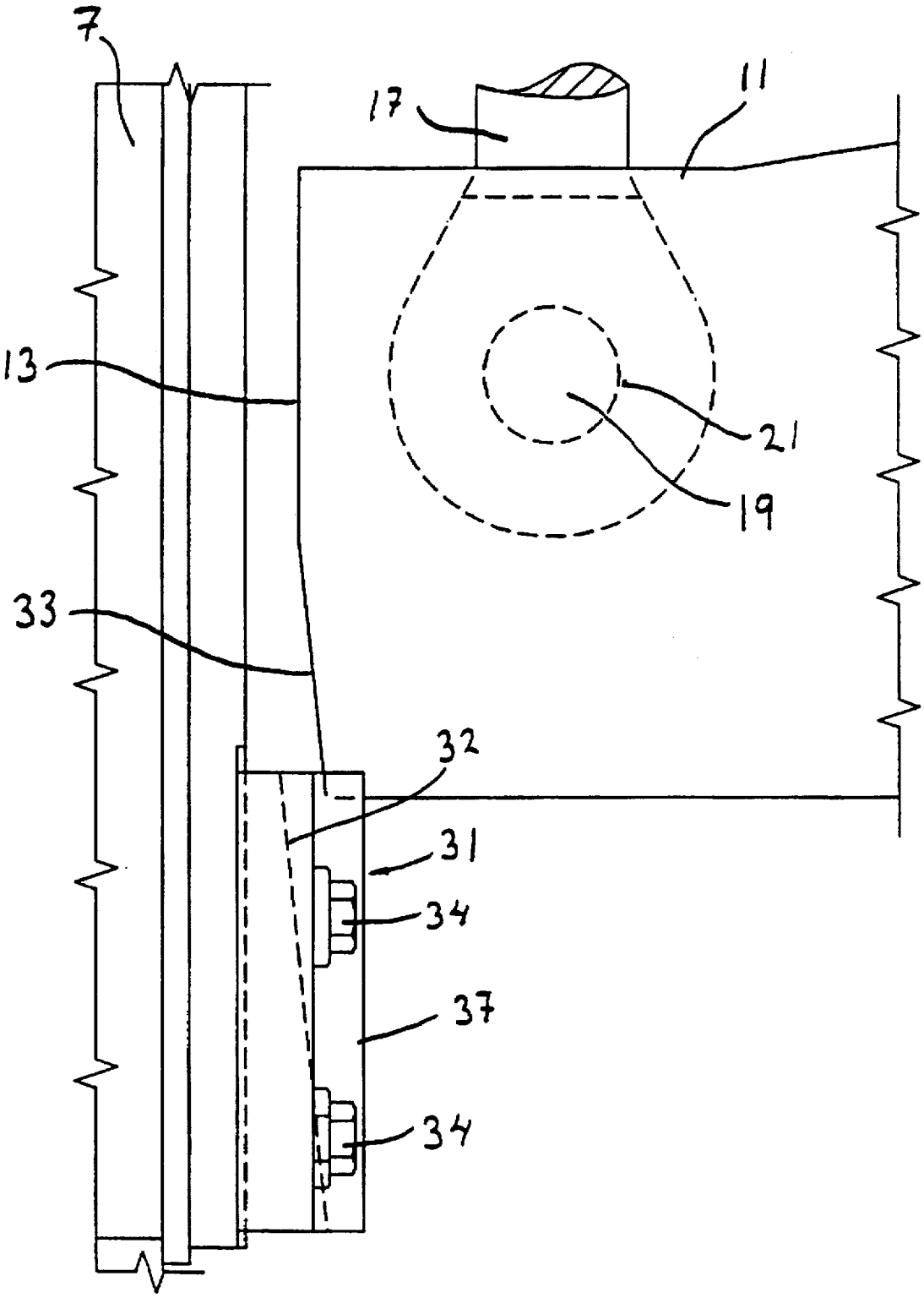
FIG. 2 shows in greater detail the section II indicated with a dashed line in FIG. 1 in which the bracket with its roll is in its lifted position.
Figure 3:
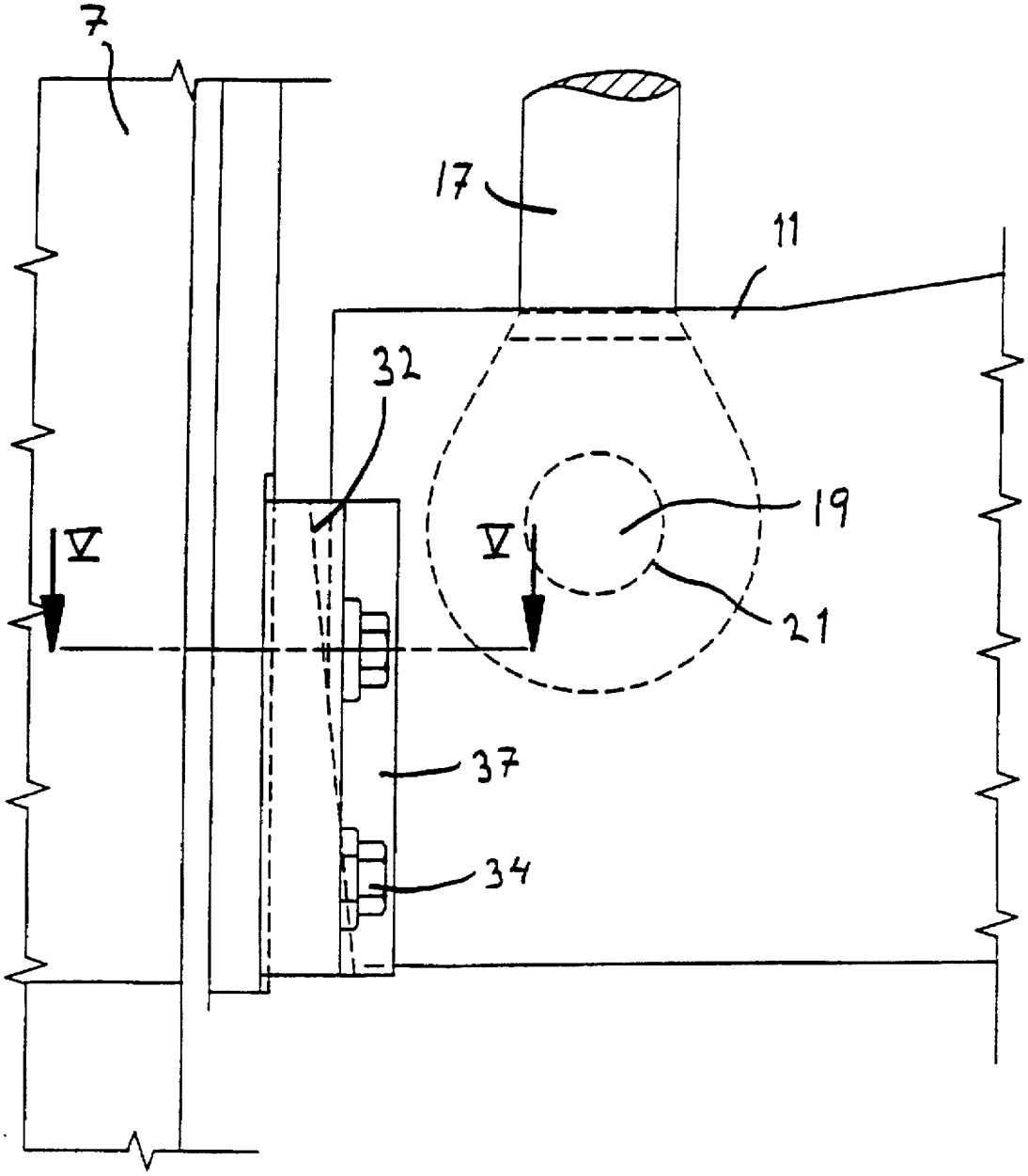
FIG. 3 is a view similar to FIG. 2 showing the bracket in its lowered position.
Figure 4:
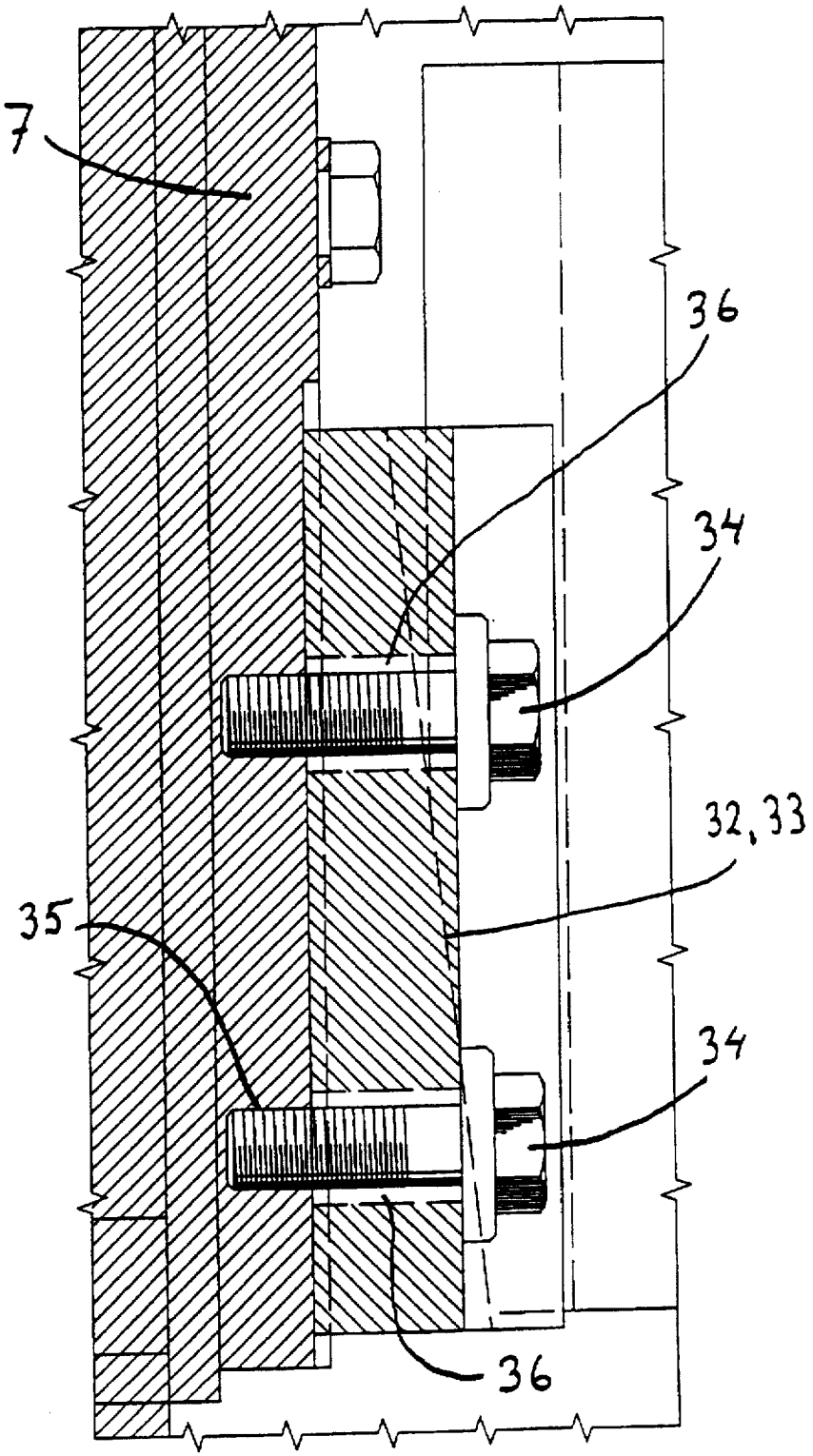
FIG. 4 is a cross sectional view corresponding to FIG. 3.

With reference to FIG. 2, FIG. 3 and FIG. 4, the upstream end 11 of the bracket 10 has an end surface 13 facing in a direction towards the vertical column 7, i.e. in the machine direction. The lower part of the end surface 13 is bevelled so as to form an inclined portion 33. On the downstream end 12 of the bracket, there is a similar end surface which is bevelled so as to form a similar inclined portion. The inclined portions 33 on the end surfaces of the bracket converge towards the press plane of the machine.

A plate member 31 is mounted on the first vertical column 7 by screws 34 extending through holes 36 in the plate members into engagement with threaded bores 35 in the vertical column 7. The plate member 31 is facing in the machine direction and has a generally vertical guide and support surface 32 for the bracket 10, the guide and support surface facing in the machine direction and being inclined in a downward direction towards the press plane. It should be understood that there is a similar plate member on the second vertical column 8 and that the guide and support surface on the first, upstream column is facing that on the second, downstream column so that the guide and support surfaces 32 define between them a gap converging in a downward direction. The inclination of the guide and support surfaces 32 is equal to the inclination of the inclined portions 33 of the end surfaces 13 of the bracket 10.

The angle of the inclination is slightly larger than the friction angle. The friction angle should here be understood as the angle that is defined by the equation $\arctan \mu = \alpha$ where $\mu$ is the coefficient of friction between the inclined surface 32 and the inclined portion 33 and $\alpha$ is the friction angle. In practice it will be on the order of 4° to 10° in relation to the vertical plane. Since the inclined portions 33 of the bracket and the inclined surfaces 32 of the plate members have the same inclination, the inclined portions 33 will be adapted to co-operate with the plate members 33 on the columns 7, 8, in such a way that when the bracket 10 with its top roll is lifted or lowered, the plate members with their guide and support surfaces 32 and the co-operating inclined portions 33 will guide the bracket and during operation of the machine they will stabilize the top roll in the machine direction.

Figure 5:
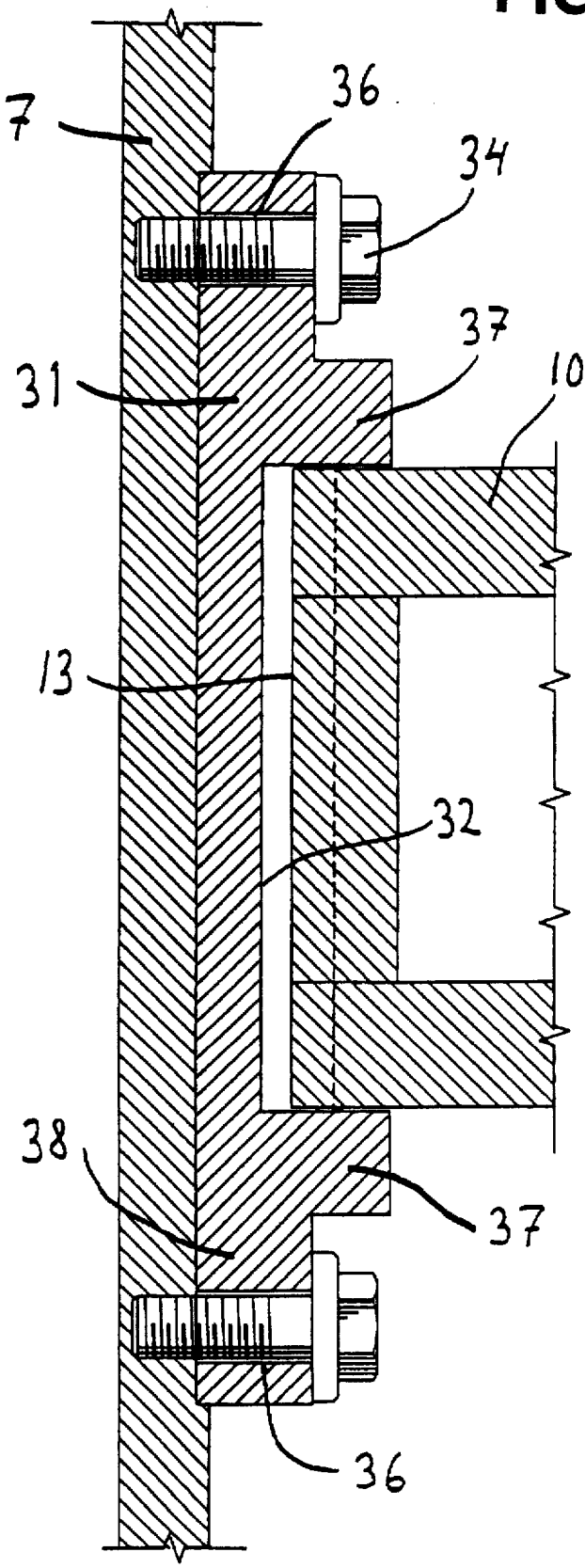
FIG. 5 is a view along the line V—V in FIG. 3.

The shape of the plate member 31 is perhaps best understood by looking at FIG. 5, which shows a cross sectional view from above of the plate member 31 and the bracket 10. As shown in FIG. 5, the inclined surface 32 has a width in the cross-machine direction which is equal to the width of the end surface 13 of the bracket 10 in the cross-machine direction and the plate member has two projecting flanges 37 projecting in a direction parallel with the machine direction, one on each side of the inclined surface 32, the flanges 37 being adapted to receive between them the upstream end 11 of the bracket 10. The flanges 37 are thus adapted to co-operate with the ends of the bracket 10 in such a way that when the top roll is in a lowered position, each end 11, 12 of the bracket 10 will be located between the flanges 37 of one of the plate members so that the flanges will stabilize the bracket with its top roll in a cross machine direction.

The plate member 31 has a pair of flat sections 38, one on each side of the projecting flanges, extending in a cross machine direction, provided with holes 36 for the screws. As best seen in FIG. 4, the holes 36 in the plate member 31 are not circular, but formed as elongate slots in order to permit vertical positioning of the plate member The plate members are thus adjustably mounted in respect of vertical position on the vertical columns 7, 8 by the screws 34 which extend through the elongate slots 36 into engagement with the threaded bores 35 in the vertical columns 7, 8.

The installation of the lifting device will now be explained with reference to FIGS. 1 to 3. Starting from an unloaded state of the machine where the brackets 10 together with the upper bearing housings and upper roll 1 are in a lifted position, as indicated in FIG. 2, the brackets are lowered until the upper bearing housings come to rest on the lower bearing housings 4. The plate members 31 are fastened to the columns 7, 8, but the screws 34 have not been tightened. When the brackets are lowered, the upstream and downstream ends of the brackets will pass between the projecting flanges 37 of the plate members 31 and the inclined portions 33 of the brackets will meet the inclined surfaces 32 of the plate members 31. The inclined surfaces of the plate members 31 will co-operate with the inclined portions 33 of the brackets 10 to guide the brackets in their downward path.

When the brackets have been fully lowered, as indicated in FIG. 1 and FIG. 3, and the upper bearing housings 3 are resting on lower bearing housings 4, the vertical position of the plate members 31 can be adjusted. The adjustment can be carried out by hitting a plate member from below with a tool such as a hammer or, alternatively, by an adjusting screw (not shown) on each one of the columns 7, 8 which engages a bottom surface of an associated plate member 31 in order to facilitate vertical positioning of the plate member When a plate member 31 is hit or pressed upwards, its vertical position can be adjusted since the elongated slots 36 for the screws 34 have a vertical extension so that the plate members will be adjustably mounted on the columns 7, 8.

When the play between the inclined portions 33 of the brackets 10 and the inclined surfaces 32 of the plate members 31 has been eliminated, the screws 34 are firmly tightened so that the plate members are locked in their vertical positions. The plate members 31 are then in a position to support the brackets 10 and thereby the upper bearing housings 3 and the upper roll 1 in the machine direction during operation of the press. The projecting flanges 37 will at the same time support the brackets, the upper bearing housings 3 and the upper roll 1 in a cross machine direction since the upstream and downstream ends of the brackets are secured between the flanges 37.

When a worn felt 27, 28 is to be replaced, the connecting element 5 which connects the upper and the lower bearing housings to each other is removed and the bracket 10 is lifted by activating the hydraulic cylinders 15 and 16. Since the angle of inclination of the inclined portions 33 and the inclined surfaces 32 is slightly larger than the friction angle, there is no risk of locking between those parts, and the brackets together with the upper bearing housings and the upper roll can be lifted without obstruction. Thereafter the removable intermediate pieces 23 to 26 on the tender side are removed. The space now available due to the lifting of the roll 1 and the removal of the intermediate pieces permits introduction of a fresh continuous loop felt into the press.

The invention permits a quick and easy replacement of worn felts, a compact frame design thanks to the vertical lifting and lowering of the upper press roll. The invention also achieves stabilization of the roll in both the machine direction and the cross-machine direction.

That which is claimed is:

1. A top roll lifting arrangement in a roll press in a press section of a papermaking or boardmaking machine having a drive side and a tender side, the roll press including a top roll and a bottom roll and the rolls being opposed and parallel and having main axes which define a generally vertical press plane, and which together form a press nip, and where the roll press has a framework for the rolls, the framework including two side frames in parallel relationship to each other, one located on the drive side and the other one on the tender side of the machine, each of the side frames having a first and a second vertical column, the first column being located upstream of the press nip and the second column being located downstream of the press nip, wherein the arrangement comprises:

(a) a bracket adjacent each of the side frames for suspending the top roll therebelow, each bracket having a first end upstream of the press nip and adjacent to the first vertical column, and a second end downstream of the press nip and adjacent to the second vertical column;

(b) a lifting device connected to at least one of the side frames for lifting and lowering the brackets;

(c) a plate member mounted on each vertical column, each plate member having an inclined guide and support surface facing the opposite plate member of the respective side frame so as to define between the inclined guide and support surfaces of each side frame a gap converging in a downward direction; and (d) an inclined portion formed at each end of the brackets, the inclined portions converging in a downward direction towards the press plane and structured to co-operate with the plate members on the columns in such a way that, when the brackets are lowered, the guide and support surfaces and the co-operating inclined portions of the bracket ends will guide the bracket, and during operation of the machine they will stabilize the top roll in the machine direction.

2. A lifting arrangement according to claim 1, wherein each plate member has two projecting flanges, one on each side of the inclined guide and support surface, the flanges projecting in a direction parallel with the machine direction and adapted to co-operate with the respective ends of the brackets in such a way that, when the top roll is in a lowered position, each end of the bracket will be located between the flanges of one of the plate members so that the flanges will stabilize the bracket with its top roll in a cross machine direction.

3. A lifting arrangement according to claim 1, wherein the plate members are adjustably mounted on the vertical columns to permit vertical positioning of the plate members.

4. A lifting arrangement according to claim 3, wherein each plate member has a pair of flat sections provided with elongate slots, the vertical columns have threaded bores, and the plate members are adjustably mounted in a vertical direction on the vertical columns and may be fixed in position by screws extending through the elongate slots and engaging the threaded bores.

5. A lifting arrangement according to claim 1, wherein the lifting device is mounted on a top beam horizontally interconnecting the first and second vertical columns of at least one side frame and further comprises two actuators, wherein one of the actuators is connected to the upstream end of the respective bracket and the other connected to the downstream end of the bracket.

6. A lifting arrangement according to claim 1, wherein the inclination of the guide and support surfaces of the plate members in relation to a vertical plane is on the order of 4° to 10°.

* * * * *